United States Patent [19]

Takegawa

[11] Patent Number: 4,744,393

[45] Date of Patent: May 17, 1988

[54] PICKING OPERATION CONTROL METHOD AND CONTROLLER FOR CARRYING OUT SAME

[75] Inventor: Yujiro Takegawa, Ishikawa, Japan

[73] Assignee: Tsudakoma Corp., Ishikawa, Japan

[21] Appl. No.: 931,367

[22] Filed: Nov. 14, 1986

[30] Foreign Application Priority Data

Nov. 15, 1985 [JP] Japan ..... 60-256033

[51] Int. Cl.[4] ..... D03D 49/50

[52] U.S. Cl. ..... 139/116; 139/452; 139/435

[58] Field of Search ..... 139/116, 429, 435, 450, 139/452

[56] References Cited

U.S. PATENT DOCUMENTS

| | | | |
|---|---|---|---|
| 4,446,893 | 5/1984 | Gunneman et al. | 139/435 |
| 4,531,557 | 6/1985 | Takegawa. | |
| 4,558,723 | 12/1985 | Tanaka et al. | 139/452 |
| 4,590,972 | 5/1986 | Sugita et al. | 139/435 |
| 4,595,039 | 6/1986 | Tholander | 139/435 |
| 4,607,668 | 6/1986 | Tholander. | |

FOREIGN PATENT DOCUMENTS

| | | | |
|---|---|---|---|
| 105561 | 4/1984 | European Pat. Off. | 139/435 |
| 60-110952 | 6/1985 | Japan . | |
| 259652 | 12/1985 | Japan | 139/435 |

*Primary Examiner*—Henry S. Jaudon

*Attorney, Agent, or Firm*—Wenderoth, Lind & Ponack

[57] ABSTRACT

A weft yarn is wound on a storage drum, and is withdrawn from the storage drum and inserted into a shed of a loom by a picking arrangement. A retaining pin is movable between first and second positions in which it respectively permits and obstructs removal of the yarn from the drum. A sensor is provided at a location spaced from the arrival end of the shed. A control arrangement responsive to the sensor effects movement of the retaining pin, and adjusts the point in time at which it moves the pin from its second to its first position in response to signals generated by the sensor during yarn insertion.

7 Claims, 2 Drawing Sheets

PICKING OPERATION CONTROL METHOD AND CONTROLLER FOR CARRYING OUT SAME

FIELD OF THE INVENTION

The present invention relates to a picking device for a fluid loom and, more specifically, to a picking operation control method and a controller for controlling the component members of the picking device.

BACKGROUND OF THE INVENTION

A drum-type weft measuring and storing device winds a length of weft yarn longer than that required for one picking cycle on a measuring and storing drum, and restrains or releases the weft yarn wound on the measuring and storing drum by controlling a restraining pin disposed adjacent to the circumference of the measuring and storing drum so as to be advanced and retracted. In one cycle of the weaving operation of the loom, the retraction of the restraining pin, hence the release of the weft yarn, is phased with pick starting timing, while the advancement of the restraining pin, hence the restraint of the weft yarn, corresponds directly with the control of the length of the weft to be unwound in one picking cycle.

Conventionally, the restraining pin is controlled for advancement and retraction by a cam mechanism or the like in synchronism with the weaving operation of the loom. Accordingly, the weft release timing always coincides with a fixed crankshaft angle of the loom.

However, the variation of the baloon of the weft yarn or of resistance against the movement of the weft yarn during unwinding of the weft yarn from the measuring and storing drum due to the variation of the outside diameter of the weft feed package or other causes the variation of the crankshaft angle of arrival of the picked weft yarn at the arrival position on the opposite side of the loom and hence the variation of the traveling speed of the weft yarn. If the restraining pin advancing crankshaft angle is fixed irrespective of the variation of the traveling speed of the weft yarn, the weft yarn measuring and storing device is unable to supply a fixed length of the weft yarn for picking operation, and thereby an excessive or insufficient length of the weft yarn is inserted. Consequently, normal picking operation control is impossible. The same problem occurs with other picking operation control member, namely, the picking nozzle.

On the other hand, the present invention is an improvement of an invention disclosed in Japanese Patent Laid-open Publication No. 60-259,652. This prior invention detects the actual crankshaft angle of arrival of the weft yarn at the final arrival position on the weft yarn receiving side, namely, the side opposite the picking side, of the loom. Accordingly, the system of the prior invention is susceptible to the vibration of the free end of the weft yarn and fly, and is liable to malfunction frequently. Furthrmore, since this system measures the actual crankshaft angle of arrival of the weft yarn after the completion of the picking operation, and then starts computation for determining control data, the control operation is delayed, and hence the system is incapable of rapid control operation.

SUMMARY OF THE INVENTION

Accordingly, it is an object of the present invention to stabilize the picking operation of a picking device by controlling the timing of actuating the pick control members such as the restraining pin and the picking nozzle to fix the crankshaft angle for ending the operation of the pick control members so that the crankshaft angle of arrival of the picked weft yarn at the weft yarn receiving side is always fixed.

According to the present invention, actual arrival crankshaft angles of successive picked weft yarns are estimated by detecting the passage of the weft yarns at a detection position on the picking side or in the shed between the picking side and the receiving side, then the estimated arrival crankshaft angles or the moving averages of the estimated arrival crankshaft angles are compared with a standard arrival crankshaft angle, and then timing for actuating the picking operation control member, namely, timing for retracting the restraining pin or timing for starting the jet of the picking nozzle, is regulated automatically on the basis of the result of comparison. The arrival crankshaft angle is controlled so as to fall within a target range irrespective of the variation of the traveling speed of the picked weft yarn by regulating the picking operation control member actuating timing without varying the pressure of the picking fluid and jet completion timing.

That is, according to the present invention, the picking operation control member actuating timing, namely, the weft yarn unwinding timing or the jet starting timing, is so regulated in relation to the traveling speed of the weft yarn, hence the length of the inserted weft yarn, that the arrival crankshaft angle always falls within a fixed range. Accordingly, the arrival crankshaft angle is always fixed even if picking conditions, particularly, the characteristics of the weft yarn and the outside diameter of the feed package, vary. Therefore, the loom is able to achieve stable synchronous weaving operation.

Particularly, since the actual arrival crankshaft angle at which the picked weft yarn arrives at the arrival position is estimated by detecting the picked weft yarn at a position other than the final arrival position, the malfunction of the picking operation controller attributable to the influence of fly is avoided, and the turbulent movement of the free end of the weft yarn is diminished. Thus, the present invention enhances the reliability of detection.

The above and other objects, features and advantages of the present invention will become more apparent from the following description taken in conjunction with the accompanying drawings.

DESCRIPTION OF THE PREFERRED EMBODIMENT

Figure 1:
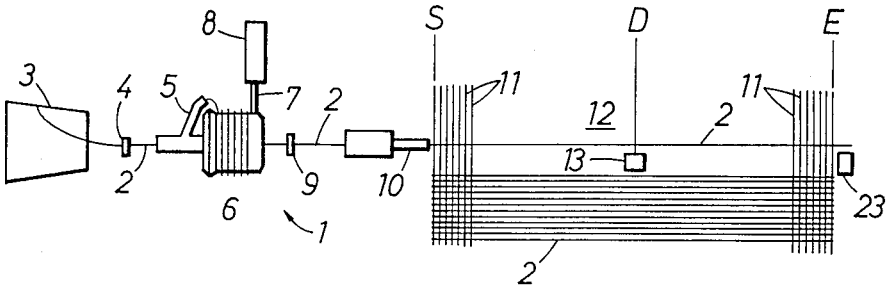
FIG. 1 is a schematic side elevatin of a picking device.

Referring to FIG. 1 showing the general constitution of a picking device 1 into which the present invention is incorporated, a weft yarn 2 wound on a feed package 3 is pulled through a baloon guide 4 into a hollow winding arm 5. The winding arm 5 winds the weft yarn 2 around a stationary measuring and storing drum 6. A restraining pin 7 serving as a picking operation control member is advanced or retracted to restrain the weft yarn 2 on or to release the same from the drum 6, respectively. The restraining pin 7 is provided so as to be movable diametrically of the drum 6 and is interlocked with, for example, an electromagnetic actuator 8. The restraining pin 7 is driven by the actuator 8 so as to move into a hole or a groove formed in the circumference of the drum 6 in order to restrain the weft yarn 2 on the drum 6, while the restraining pin 7 is driven by the actuator 8 so as to move away from the drum 6 in order to release the weft yarn 2 from the drum 6 so that the weft yarn can be unwound from the drum 6. The weft yarn 2 wound on the drum 6 and released from the restraint of the restraining pin 7 is picked through a yarn guide 9 by a picking nozzle 10 serving as one of the picking operation control members, together with the jet of a picking fluid into a shed 12 formed by warp yarns 11.

The actual traveling condition of the weft yarn 2 is detected by, for example, a photoelectric sensor 13 at a detecting position D within the shed 12. The detecting position D is located at an appropriate position between one end of the shed 12 on the picking side and the other end of the shed 12 on the arrival side, other than the final arrival position of the weft yarn 2. Incomplete picking operation is detected electrically by a feeler disposed at the final arrival position E.

Figure 2:
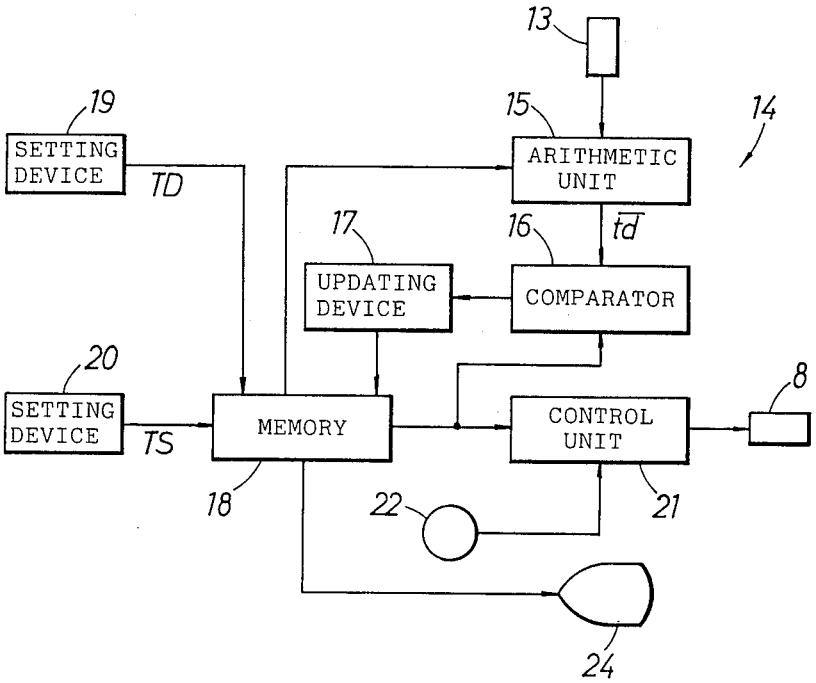
FIG. 2 is a block diagram of a picking operation controller, in a preferred embodiment, according to the present invention.

Referring to FIG. 2 showing the constitution of a picking operation controller 14 according to the present invention, the sensor 13 is connected to the input of an arithmetic unit 15, which is connected through a comparator 16 to an updating device 17 and a memory 18. A reference arrival crankshaft angle setting device 19 for setting a reference arrival crankshaft angle TD, and a reference retracting crankshaft angle setting device 20 for setting a reference retracting crankshaft angle TS are connected to the input of the memory 18. The comparator 16 and a control unit 21 are connected to the output of the memory 18. An encoder 22 for detecting the phase angle of the crankshaft of the loom is connected to the input of the control unit 21, while the actuator 8 is connected to the output of the control unit 21. If necessary, a display unit 24 is connected to the memory 18.

The picking operation control member actuating timing will be described with reference to FIG. 3 in terms of the relation between the reference retracting crankshaft angle TS for retracting the restraining pin 7 and the reference arrival crankshaft angle TE at which the weft yarn 2 arrives at the arrival position in the normal picking operation.

Figure 3:
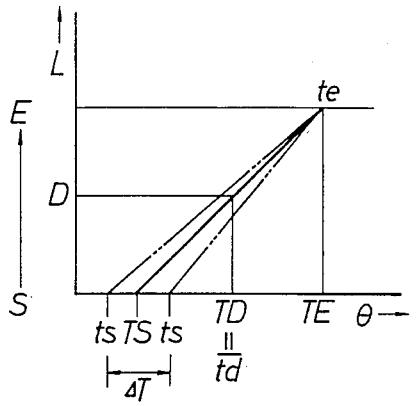
FIG. 3 is a graph showing the relation between weft yarn unwinding crankshaft angle and arrival crankshaft angle.

In FIG. 3, the crankshaft angle $\theta$ is measured on the x-axis (horizontal axis) and the distance L traveled by the weft yarn from the pick starting position S is measured on the y-axis (vertical axis). The reference arrival crankshaft angle TE at which the free end of the picked weft yarn 2 arrives at the final arrival position E is determined from a predetermined pick starting crankshaft angle, namely, the reference retracting crankshaft angle TS. Suppose that the picked weft yarn 2 travels at a fixed speed, for convenience' sake. Then, the variation of the distance from the pick starting position S with the crankshaft angle is indicated by a solid straight line in FIG. 3. Thus, the reference arrival crankshaft angle TD corresponding to the detecting position D is determined. The reference arrival crankshaft angle TD can similarly be determined when the traveling characteristic of the weft yarn is represented by a curve. The traveling speed of the weft yarn at a specific crankshaft angle is represented by the gradient of the straight line or the gradient of the tangent to the curve at a point corresponding to the specific crankshaft angle.

However, since the traveling speed of the weft yarn 2 is variable as mentioned above, the retracting crankshaft angle ts must be advanced or delayed in order to make the actual arrival crankshaft angle te coincide with the reference arrival crankshaft angle TE. For example, when the actual traveling speed is lower than the reference traveling speed, the actual retracting crankshaft angle ts must be advanced accordingly and, on the contrary, when the actual traveling speed is higher than the reference traveling speed, the actual retracting crankshaft angle ts must be delayed. In FIG. 3, $\Delta T$ is the differential crankshaft angle between the smallest crankshaft angle for the lowest traveling speed and the largest crankshaft angle for the highest traveling speed, defining a range of crankshaft angle for adjusting the actual retracting crankshaft angle ts.

Figure 4:
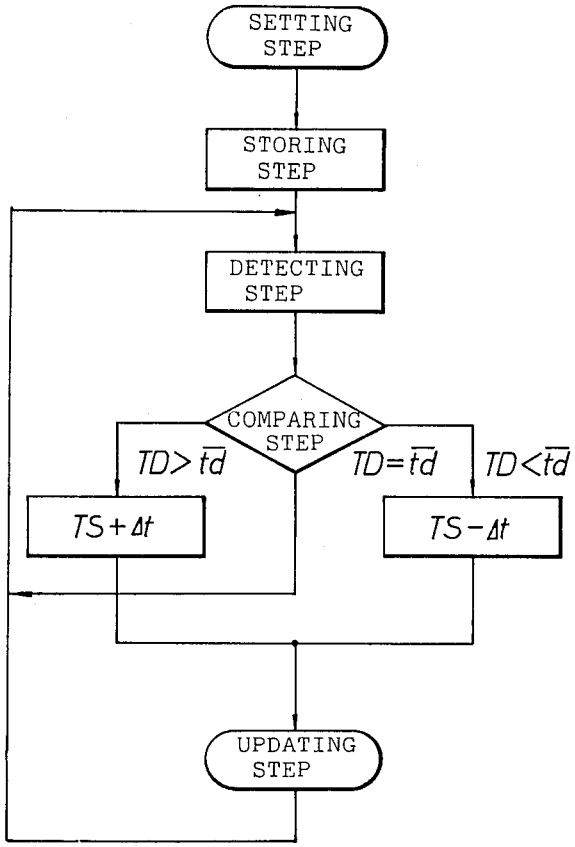
FIG. 4 is a flow chart showing the control routine of the picking operation controller of FIG. 2.

The function of the picking operation controller 14 will be described with reference to the flow chart shown in FIG. 4.

The reference arrival crankshaft angle setting device 19 and the reference retracting crankshaft angle setting device 20 set a reference arrival crankshaft angle TD and a retracting crankshaft angle TS, respectively. The reference arrival crankshaft angle TD and the reference retracting crankshaft angle TS are stored in the memory 18. These set values TD and TS can visually be recognized on the display unit 23.

While the loom is in weaving operation, the sensor 13 detects the free end of the picked weft yarn at the detecting position D to determine the actual arrival crankshaft angle td and gives a detection signal to the arithmetic unit 15 (deteting step). The arithmetic unit 15 receives the detection signal periodically every fixed number of picking cycles or continuously every picking cycle and calculates the moving average $\overline{td}$ of the measured arrival crankshaft angles and gives the same to the comparator 16. The comparator 16 compares the moving average td with the reference arrival crankshaft angle TD which has previously been stored in the memory 18 (comparing step).

When $\overline{td}=TD$ (the continuous line in FIG. 3), the mode of picking operation is normal, and hence any particular correcting operation is not necessary.

Figure 5:
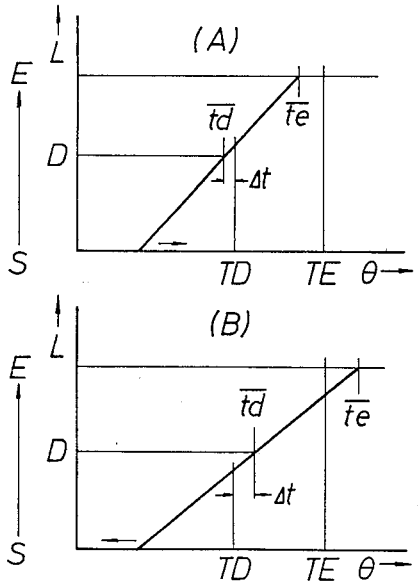
FIGS. 5A and 5B are graphs of assistance in explaining the manner of correcting weft yarn unwinding crankshaft angle.

When $\overline{td}<TD$ as illustrated in FIG. 5A, the actual traveling speed of the weft yarn 2 is higher than the reference traveling speed. Then, the updating unit 17 adds the differential crankshaft angle $\Delta t=TD-\overline{td}$ to the reference retracting crankshaft angle TS, and then stores $TS+\Delta t$ in the memory 18 to update the contents of the memory 18 (updating step). Thereafter, the control unit 21 controls the restraining pin 7 on the basis of the updated reference retracting crankshaft angle $TS+\Delta t$ (control step). Thus, the actual arrival crankshaft angle td is corrected automatically so as to coincide with the reference arrival crankshaft angle TD. Consequently, the actual arrival crankshaft angle te at which the weft yarn arrives at the final arrival position E is corrected automatically so as to coincide with the reference arrival crankshaft angle TE.

When $\overline{td} > TD$ as illustrated in FIG. 5B, the actual traveling speed of the weft yarn 2 is lower than the reference traveling speed. Then, the updating unit 17 adds the differential crankshaft angle $-\Delta T = TD - \overline{td}$ to the reference retracting crankshaft angle TS and then stores $TS - \Delta t$ in the memory 18 to update the reference retracting crankshaft angle. Thereafter, the control unit 21 controls the restraining pin 7 on the basis of the updated reference retracting crankshaft angle (control step). Thus, the actual arrival crankshaft angle td is corrected automatically so as to coincide with the reference arrival crankshaft angle TD on the basis of the results of the preceding sampling operation.

Accordingly, even if the traveling speed of the weft yarn 2 varies, the picking timing is regulated automatically; consequently, the actual arrival crankshaft angle te at which the weft yarn 2 arrives at the final arrival position is controlled so as to coincide always with the reference arrival crankshaft angle TE. Since the automatic regulation of the picking timing is started while the weft yarn 2 is being picked, a sufficient time is spared for the regulation. When the response speed of the regulating operation is sufficiently high, a series of control operations for regulating the picking timing can be executed for every picking cycle instead of fixed number of picking cycles on the basis of the moving average $\overline{td}$ obtained from the past samples. When the regulating operation is executed for every picking cycle, the actual arrival crankshaft angle td is determined while the free end is traveling across the shed 12, then the final arrival crankshaft angle te is estimated before the completion of the present picking cycle, and then the estimated final arrival crankshaft angle is used for regulating the timing of the next picking cycle. Thus, a new reference retracting crankshaft angle $TS + \Delta t$ or $TS - \Delta t$ is set for the next picking cycle before the completion of the present picking cycle. In such a mode of regulation, operation for calculating the moving average is not necessary.

Although the actual retracting crankshaft angle ts is advanced or delayed with respect to the reference retracting crankshaft angle TS, the crankshaft angle varying range $\Delta T$ is so determined that the crankshaft angle for the earliest retracting timing is greater than the crankshaft angle at which the picking nozzle 10 is actuated for jetting the picking fluid. However, when the estimated retracting crankshaft angle is smaller than the jet starting crankshaft angle, the timing for actuating the picking nozzle 10, namely, the jet starting crankshaft angle, needs to be advanced. Thus, the picking nozzle 10, in addition to the restraining pin 7 is also a controlled member.

Although the embodiment described herein employs an electromagnetic actuator as the actuator 8, naturally, the actuator 8 may be of any other suitable type. Although the invention has been described as applied to a picking device having a single restraining pin, the present invention is applicable also to a picking device having a plurality of restraining pins distributed around the circumference of the measuring and storing drum.

Furthermore, the detecting position D need not necessarily be located within the shed 12, but may be located a position on the circumference of the measuring and storing drum 6. When the detecting position is located on the circumference of the measuring and storing drum 6, the length of the inserted weft yarn 2 can indirectly be measured by counting the number of turns of the unwound weft yarn.

What is claimed is:

1. A method for controlling the picking operation of a picking device which includes a measuring and storing drum around which a weft yarn is wound for temporary storage, a restraining pin movable between an advance position in which it prevent withdrawal of the weft yarn from the measuring and storing drum and a retracted position in which it permits withdrawal of the weft yarn from the measuring and storing drum, and a picking nozzle for picking the weft yarn withdrawn from the measuring and storing drum into a loom shed, comprising the steps of:

(a) detecting an actual crankshaft angle at which a predetermined part of the picked weft yarn passes a predetermined position which is spaced from a final arrival position;

(b) comparing the detected actual crankshaft angle with a reference crankshaft angle; and (c) changing on the basis of the result of the comparison a point in time at which picking movement of the weft yarn starts by changing at least one of a crankshaft angle at which the restraining pin is moved to its retracted position and a crankshaft angle at which the picking nozzle is actuated.

2. A method as recited in claim 1, including the steps of calculating a moving average of a plurality of successive detected values of the actual crankshaft angle, and carrying out said comparing step by comparing the moving average of the actual crankshaft angle with the reference arrival crankshaft angle.

3. A method as recited in claim 1, wherein said predetermined position for said detecting step is located within the loom shed.

4. A method as recited in claim 1, wherein said predetermined position for said detecting step is located in the vicinity of the measuring and storing drum.

5. A picking apparatus, comprising picking operation controller means for controlling the picking operation of a picking device, said picking device including a measuring and storing drum around which a weft yarn is wound for temporary storage, a restraining pin movable between an advance position in which it prevents withdrawal of the weft yarn from the measuring and storing drum and a retracted position in which it permits withdrawal of the weft yarn from the measuring and storing drum, and a picking nozzle which can pick the weft yarn withdrawn from the measuring and storing drum into a loom shed, said picking operation controller means including:

(a) sensor means disposed at a predetermined position spaced from a final arrival position for detecting the passage of a predetermined part of the picked weft yarn, and further means for determining an actual crankshaft angle at which the predetermined part of the weft yarn passes the predetermined position;

(b) arithmetic unit means responsive to output signals from the further means for calculating a moving average of a plurality of successive values of the actual crankshaft angle;

(c) a memory which stores a reference crankshaft angle and a start crankshaft angle;

(d) a comparator which compares the moving average of the actual crankshaft angles from the arithmetic unit means with the reference crankshaft angle from the memory;

(e) an updating unit which updates the start crankshaft angle in the memory on the basis of the result of the comparison made by the comparator; and (f) control unit means responsive to a rotating crankshaft of the loom reaching said start crankshaft angle for effecting a control operation, said control operation being one of movement of the restraining pin to its retracted position and actuation of the picking nozzle.

6. A picking apparatus as recited in claim 5, wherein said sensor means is disposed at a position within the loom shed between opposite sides thereof.

7. A picking apparatus as recited in claim 5, wherein said sensor means is disposed in the vicinity of the measuring and storing drum.

* * * * *